US008011312B2

(12) United States Patent
Finn et al.

(10) Patent No.: US 8,011,312 B2
(45) Date of Patent: Sep. 6, 2011

(54) FLOATING OIL STORAGE SYSTEM AND METHOD

(75) Inventors: Lyle David Finn, Sugar Land, TX (US); James V. Maher, Houston, TX (US); Dick Davies, Houston, TX (US); Edward E. Horton, III, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 132 days.

(21) Appl. No.: 12/549,822

(22) Filed: Aug. 28, 2009

(65) Prior Publication Data

US 2010/0051624 A1 Mar. 4, 2010

Related U.S. Application Data

(60) Provisional application No. 61/093,198, filed on Aug. 29, 2008.

(51) Int. Cl.
*B65D 88/78* (2006.01)

(52) U.S. Cl. ..... 114/256; 114/74 R

(58) Field of Classification Search ..... 114/74 R, 114/74 T, 256; 220/560
See application file for complete search history.

(56) References Cited

U.S. PATENT DOCUMENTS

| | | | | |
|---|---|---|---|---|
| 2,631,558 | A * | 3/1953 | Harris | 114/256 |
| 3,167,203 | A * | 1/1965 | Ingemund | 114/256 |
| 3,880,102 | A | 4/1975 | Biewer | |
| 4,059,065 | A * | 11/1977 | Clark et al. | 114/256 |
| 4,209,271 | A * | 6/1980 | McCabe et al. | 114/256 |
| 2002/0040904 | A1 | 4/2002 | Lee | |

FOREIGN PATENT DOCUMENTS

| | | | |
|---|---|---|---|
| KR | 100545828 | B1 | 1/2006 |
| WO | 03070562 | A1 | 8/2003 |

OTHER PUBLICATIONS

PCT/US2009/055357 International Search Report and Written Opinion, Apr. 12, 2010.

* cited by examiner

*Primary Examiner* — Lars A Olson
(74) *Attorney, Agent, or Firm* — Conley Rose, P.C.

(57) ABSTRACT

A floating oil storage system and associated methods for storing oil are disclosed. In some embodiments, the floating oil storage system includes a storage cell, a floating member disposed within the storage cell, whereby the storage cell is divided into a first compartment and a second compartment disposed below the first compartment, a pump operable to deliver oil under pressure into the first compartment, whereby the first compartment expands and the second compartment contracts expelling seawater from the second compartment, and a suction tank operable to receive oil expelled from the first compartment under hydrostatic pressure of seawater in the second compartment, whereby the first compartment contracts and the second compartment expands receiving seawater.

29 Claims, 4 Drawing Sheets

FLOATING OIL STORAGE SYSTEM AND METHOD

CROSS REFERENCE TO RELATED APPLICATIONS

This application claims benefit of U.S. provisional application Ser. No. 61/093,198 filed on Aug. 29, 2008, and entitled "Floating Oil Storage System," which is hereby incorporated herein by reference in its entirety for all purposes.

STATEMENT REGARDING FEDERALLY SPONSORED RESEARCH OR DEVELOPMENT

Not applicable.

BACKGROUND OF THE INVENTION

Embodiments of the invention relate generally to systems and methods for storing oil. More particularly, embodiments of the invention relate to a cellular spar and associated method for storing oil received from a production unit located on a multi-column floating offshore platform.

Conventionally, oil produced on a multi-column floating (MCF) offshore platform must be stored on site or offloaded to an awaiting tanker. On site storage is typically limited. Consequently, offloading to a tanker occurs at regular intervals to prevent interruption to production operations on the platform. Due to changing weather conditions at the platform, maintaining a regular offloading schedule via the use of tankers is not always possible.

Accordingly, there remains a need for an oil storage system independent from that provided by the MCF offshore platform.

SUMMARY OF THE PREFERRED EMBODIMENTS

A floating oil storage system, or cellular spar, and associated methods for storing oil are disclosed. Some methods for storing oil include transferring oil to a floating storage system having a storage cell with an oil compartment and a seawater compartment disposed below the oil compartment, delivering the oil into the oil compartment, whereby the oil compartment expands; and contracting the seawater compartment as the oil compartment expands, whereby seawater is discharged from the seawater compartment.

In some embodiments, the floating oil storage system includes a storage cell, a floating member disposed within the storage cell, whereby the storage cell is divided into a first compartment and a second compartment disposed below the first compartment, a pump operable to deliver oil under pressure into the first compartment, whereby the first compartment expands and the second compartment contracts expelling seawater from the second compartment, and a suction tank operable to receive oil expelled from the first compartment under hydrostatic pressure of seawater in the second compartment, whereby the first compartment contracts and the second compartment expands receiving seawater.

In some embodiments, the floating oil storage system includes a plurality of storage cells, each storage cell having a first compartment and a second compartment disposed below the first compartment, a first pump operable to deliver oil under pressure into the first compartment of one or more of the storage cells, whereby the first compartment expands and the second compartment contracts expelling seawater from the second compartment, a suction tank operable to receive oil expelled from the first compartment of one or more of the storage cells under hydrostatic pressure of seawater in the second compartment, whereby the first compartment contracts and the second compartment expands receiving seawater, and a second pump operable to deliver oil in the suction tank from the floating oil storage system.

Thus, the embodiments of the invention comprise a combination of features and advantages that enable substantial enhancement of couplings. These and various other characteristics and advantages of the invention will be readily apparent to those skilled in the art upon reading the following detailed description of the preferred embodiments of the invention and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
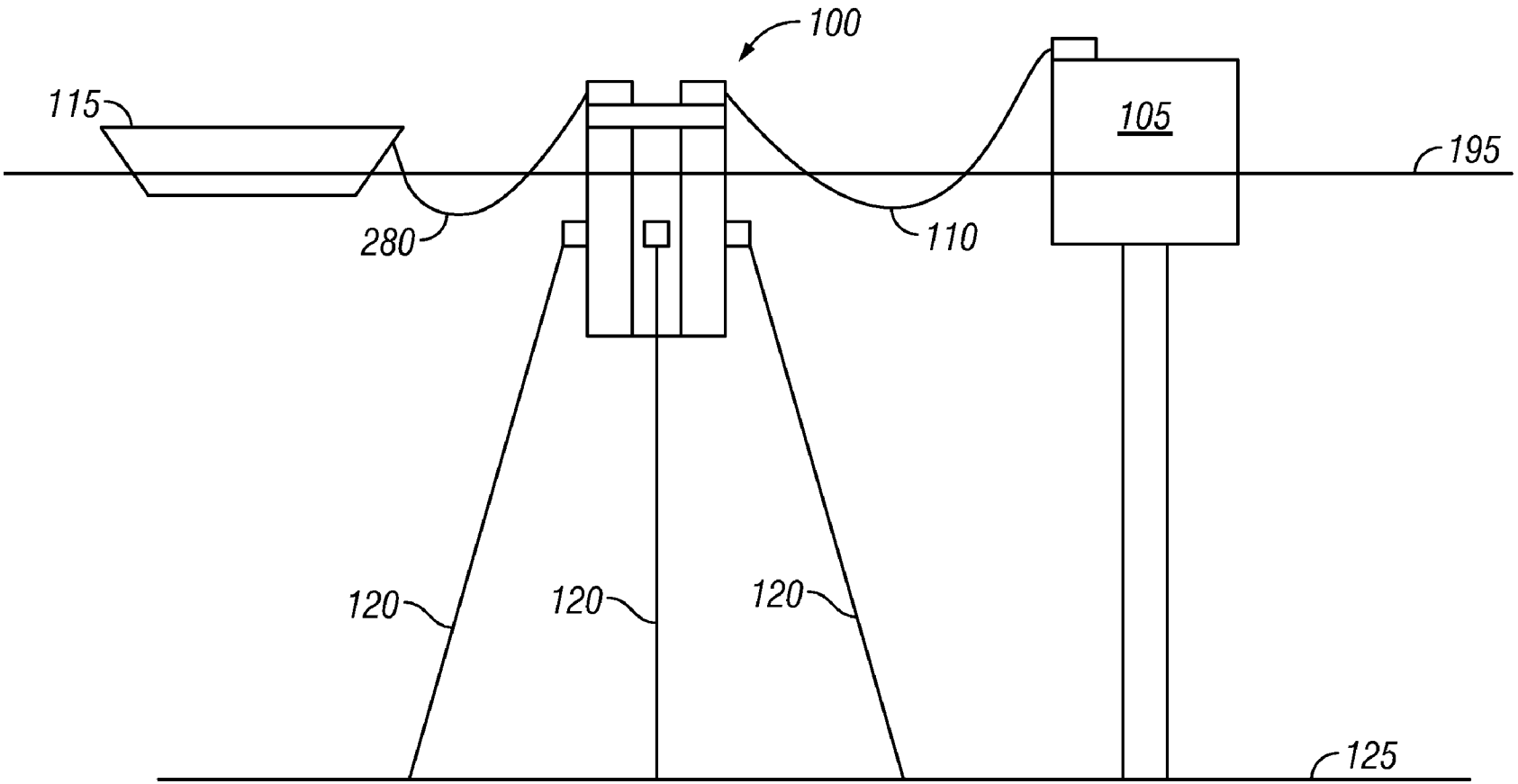
FIG. 1 is a schematic representation of a floating oil storage system in accordance with the principles disclosed herein coupled between an oil-producing offshore structure and a tanker.

Various embodiments of the invention will now be described with reference to the accompanying drawings, wherein like reference numerals are used for like parts throughout the several views. The drawings in the figures are not necessarily to scale. Certain features of the invention may be shown exaggerated in scale or in somewhat schematic form, and some details of conventional elements may not be shown in the interest of clarity and conciseness.

Also, in the following discussion and in the claims, the terms "including" and "comprising" are used in an open-ended fashion, and thus should be interpreted to mean "including, but not limited to . . . ." Further, the term "couple" or "couples" is intended to mean either an indirect or direct connection. Thus, if a first device couples to a second device, that connection may be through a direct connection, or through an indirect connection via other devices and connections.

The invention is susceptible to embodiments of different forms. There are shown in the drawings, and herein will be described in detail, specific embodiments of the invention with the understanding that the disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

Referring now to FIG. 1, a floating oil storage system 100 in accordance with the principles disclosed here and a multi-column floating (MCF), or other, offshore structure 105 are shown. Offshore structure 105 has an oil production system, or is coupled to an oil production system. Oil produced on offshore structure 105 is transferred via a transfer line 110 to floating oil storage system 100, where the oil is stored and subsequently offloaded via an oil offloading transfer line 280 to another offshore structure or vessel, for example, an awaiting tanker 115. Floating oil storage system 100 is secured in position by a plurality of mooring lines 120 coupled to the seafloor 125.

Transfer line 110 and/or offloading transfer line 280 may be temporarily installed when needed to transfer oil and subsequently removed, or permanently installed. Further, transfer line 110 and/or offloading transfer line 280 may be suspended between offshore structure 105 and floating oil storage system 100 and partially submerged, substantially as shown, or floated at sea level 195. Alternatively, transfer line 110 may extend from offshore structure 105 downward to the sea floor 125, across the sea floor 125 to below storage system 100, and upward to storage system 100. Offloading transfer line 280 may be similarly installed in the sea floor 125.

Figure 2:
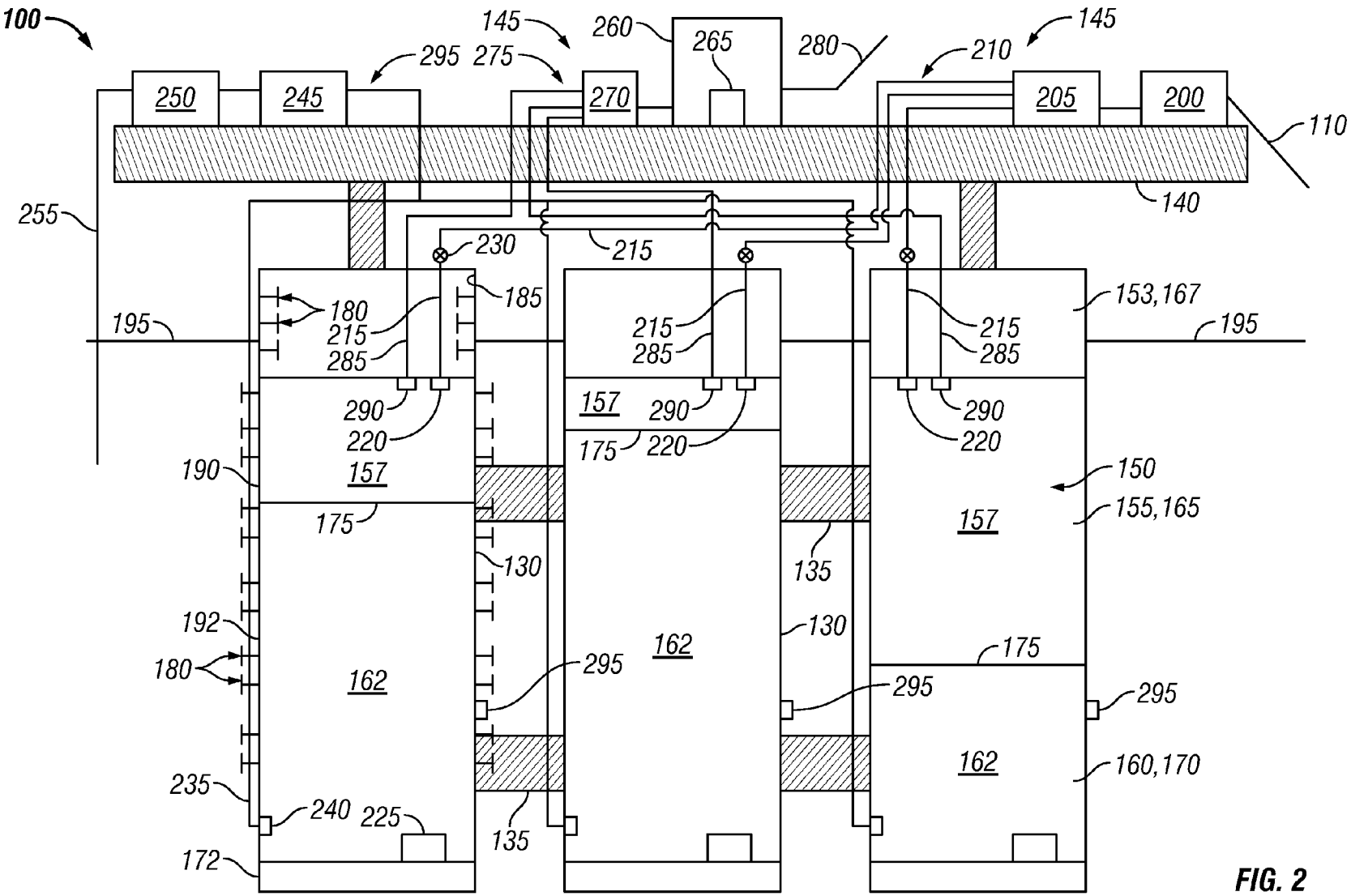
FIG. 2 is an enlarged view of the floating oil storage system of FIG. 1.
Figure 3:
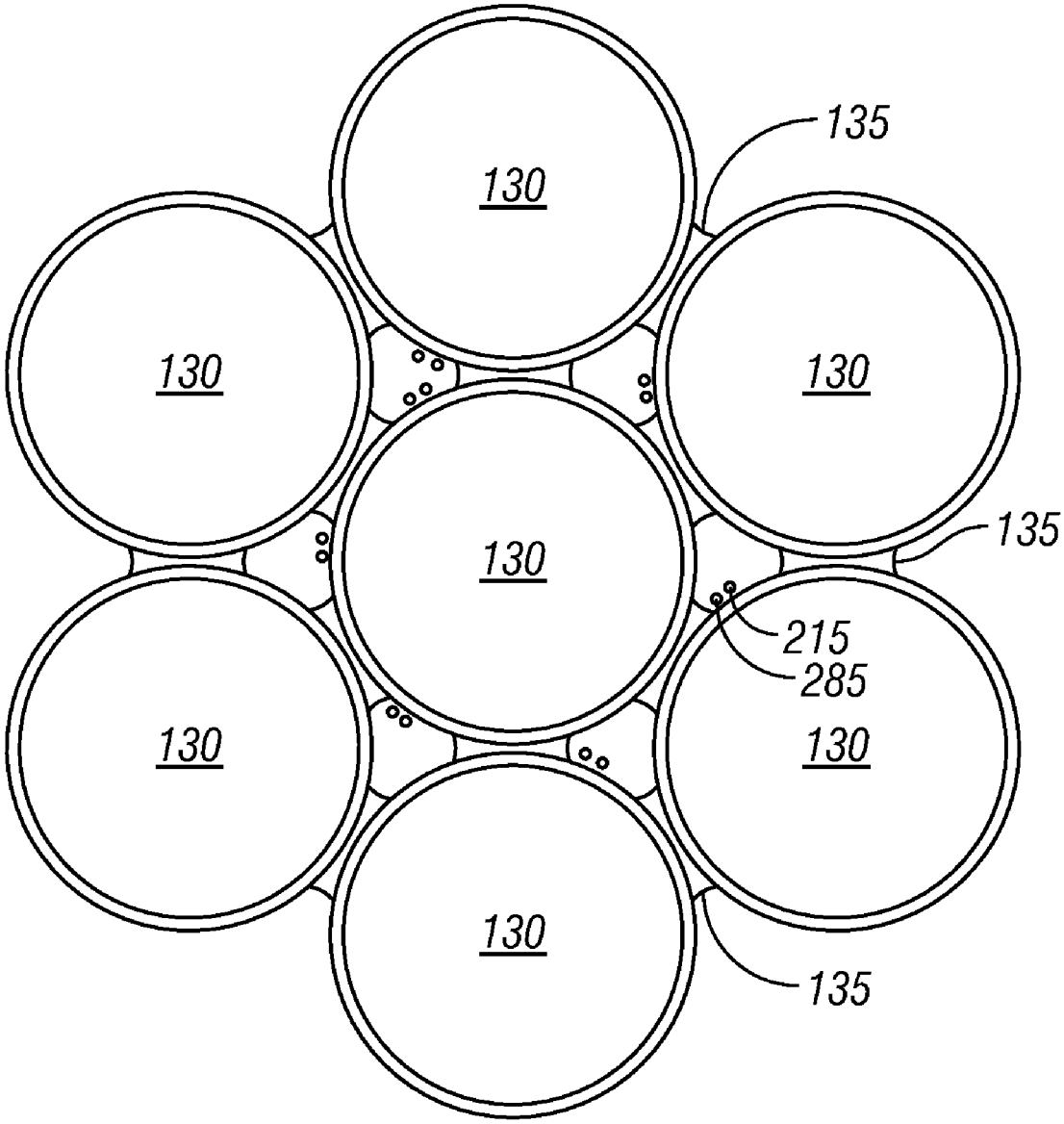
FIG. 3 is a cross-sectional view of the floating oil storage system of FIG. 2.

Turning now to FIGS. 2 and 3, floating oil storage system 100 is a cellular spar configured to receive and store oil for indefinite periods of time and to offload the stored oil upon demand. Floating oil storage system, or cellular spar, 100 includes a plurality of storage cells 130 coupled by a plurality of shear plates 135 and supporting a platform 140. In some embodiments, cellular spar 100 further includes fixed ballast 172 at the base of each cell 130. Preferably, spar 100 has four or seven storage cells 130. In this embodiment, spar 100 has seven storage cells 130, as is illustrated by FIG. 3. Referring still to FIG. 2, spar 100 further includes subsystems and components 145 disposed on platform 140 and useful, or necessary, for the operation of spar 100, described in detail below.

Each storage cell 130 has an interior volume 150 separated into three compartments, an upper compartment 153, a middle compartment 155 for storing oil 157, and a lower compartment 160 for receiving seawater 162. Upper compartment 153 is empty and provides buoyancy for cellular spar 100. Upper compartment 153 has a fixed or constant interior volume 167, whereas middle and lower compartments 155, 160 have variable interior volumes 165, 170, respectively, depending upon the quantity of oil 157 stored in compartment 155. During operation, compartments 155, 160 preferably remain full of oil 157 and seawater 162, respectively. In such circumstances, the sum of volume 165 of oil 157 in compartment 155 and volume 170 of seawater 162 in adjacent compartment 160 is constant and approximately equal to volume 150 of storage cell 130 less volume 167 of upper compartment 153.

Storage cell 130 further includes a floating member 175 disposed therein. Floating member 175 is a barrier between oil 157 and seawater 162 contained in storage cell 130. As such, floating member 175 prevents significant mixing of oil 157 contained in middle compartment 155 and seawater 162 within lower compartment 160. Further, floating member 175 displaces within storage cell 130 as the quantity of oil 157 in cell 130 changes, and thus helps define compartments 155, 160. In some embodiments, floating member 175 is a diaphragm, bladder, inflatable bag, or other similar device.

To increase the structural capacity of cell 130, storage cell 130 further includes stiffeners 180 disposed over the inner and outer surfaces 185, 190 of storage cell 130. For simplicity, stiffeners 180 are shown on a single cell 130 in FIG. 2. In practice, however, stiffeners 180 will be included on each cell 130. In this embodiment, the placement of stiffeners 180 is dependent upon the expected draft of spar 100. Specifically, stiffeners 180 are disposed over the inner surface 185 of upper compartment 153 of storage cell 130 and over the outer surfaces 190, 192 of middle and lower compartments 155, 160. Positioning stiffeners 180 on the interior of upper compartment 153 enables easy access to spar 100 without the risk of damaging stiffeners 180 through contact with boats that may dock with spar 100. Moreover, positioning stiffeners 180 on the exterior of compartments 155, 160 leaves the inner surface 185 of cell 130 below sea level 195 smooth, which in turn, minimizes the mixing of oil 157 and seawater 162 within cell 130. In some embodiments, stiffeners 180 are configured such that each has a "T-shaped" cross-section.

To receive and store oil from offshore structure 105, spar 100 further includes a fill pump 200, a fill manifold 205, and a fill piping system 210. Fill pump 200 and fill manifold 205 are supported on platform 140. Fill piping system 210 delivers pressurized oil from pump 200 through fill manifold 205 to one or more storage cells 130, and includes a pipe branch 215 coupled between fill manifold 205 and an oil inlet port 220 to each storage cell 130. Fill pump 200 is coupled to subsea transfer line 110 (FIG. 1) to receive oil transferred from offshore structure 105. Oil received by fill pump 200 is pressurized and delivered to fill manifold 205 by fill piping system 210. Fill manifold 205 is operable to simultaneously deliver oil to one or more storage cells 130 via pipe branches 215.

During operation of fill pump 200, oil received from offshore structure 105 via subsea transfer line 110 is pressurized and delivered through fill manifold 205 to one or more storage cells 130. As oil is delivered into the one or more storage cells 130, volume 165 of middle compartment 155 of each affected cell 130 expands to receive the pressurized oil, displacing floating member 175 downward against seawater 162 in lower compartment 160. The oil must be pressurized by pump 200 prior to delivery into storage cells 130 because oil is lighter, or has a lower density, than seawater. Thus, the oil must be pushed into each storage cell 130.

In some embodiments, spar 100 further includes a measurement system 225 located at the bottom of each storage cell 130 and an emergency shutoff valve 230 coupled to piping branch 215 of each storage cell 130. For each storage cell 130, measurement system 225 measures the distance to floating member 175. The distance between measurement system 225 and floating member 175 indicates the relative sizes of volumes 165, 170. In the event that the relative sizes of volumes 165, 170 show the storage cell 130 is full of oil 157, meaning compartments 155, 160 are full of oil 157, emergency shutoff valve 230 is closed to prevent overfilling of the storage cell 130.

Spar 100 further includes a water manifold 245 and a separator 250 supported on platform 140, a seawater vent line 255, and a seawater discharge piping system 295. Seawater discharge piping system 295 delivers seawater 162 stored in each cell 130 through manifold 245 to separator 250, and includes a seawater discharge line 235 coupled to a seawater outlet port 240 located at the base of each cell 130. As previously described, when oil is delivered into the one or more storage cells 130, volume 165 of middle compartment 155 of each affected cell 130 expands to receive the pressurized oil, displacing floating member 175 downward against seawater 162 in lower compartment 160. Consequently, volume 170 of compartment 160 grows smaller or contracts, causing seawater 162 contained in the affected cell(s) 130 to be pushed from compartment 160 through its respective outlet port 240 and water discharge line 235 toward manifold 245. Manifold 245 is operable to simultaneously receive seawater 162 from one or more storage cells 130. Seawater received by manifold 245 is delivered into separator 250, where it is conditioned prior to overboard dumping via vent line 255.

To offload oil stored in cells 130, spar 100 further includes a oil suction tank 260 containing one or more oil discharge pumps 265, an oil discharge manifold 270, an oil discharge piping system 275, and oil offloading transfer line 280. In this embodiment, discharge manifold 270 and suction tank 260 are supported on platform 140. Alternatively, suction tank 260 may be disposed within one cell 130, for example, the central cell 130. Discharge piping system 275 delivers oil contained storage cells 130 through discharge manifold 270 to suction tank 260, and includes a piping branch 285 coupled between an oil outlet port 290 in each storage cell 130 and discharge manifold 270. Discharge manifold 270 is operable to simultaneously deliver oil from one or more storage cells 130 to suction tank 260. Discharge pumps 265 convey oil received by suction tank 250 through offloading transfer line 280 to an offsite location, such as tanker 115 (FIG. 1).

During operation of discharge pumps 265, oil 157 is delivered by discharge piping system 275 from one or more storage cells 130 to suction tank 260. For each affected cell 130, backpressure provided by the hydrostatic pressure of seawater 162 in compartment 155 enables delivery of the stored oil 157 to suction tank 260 without the assistance of a pump(s). As oil 157 is depleted from the affected cell(s) 130, volume 165 of compartment 155 is reduced. Due to hydrostatic pressure, seawater is simultaneously drawn into the adjacent compartment 160 through a seawater inlet port 295 disposed in each storage cell 130 below sea level 195. This enables continued delivery of stored oil 157 from compartment(s) 155.

Figure 4:
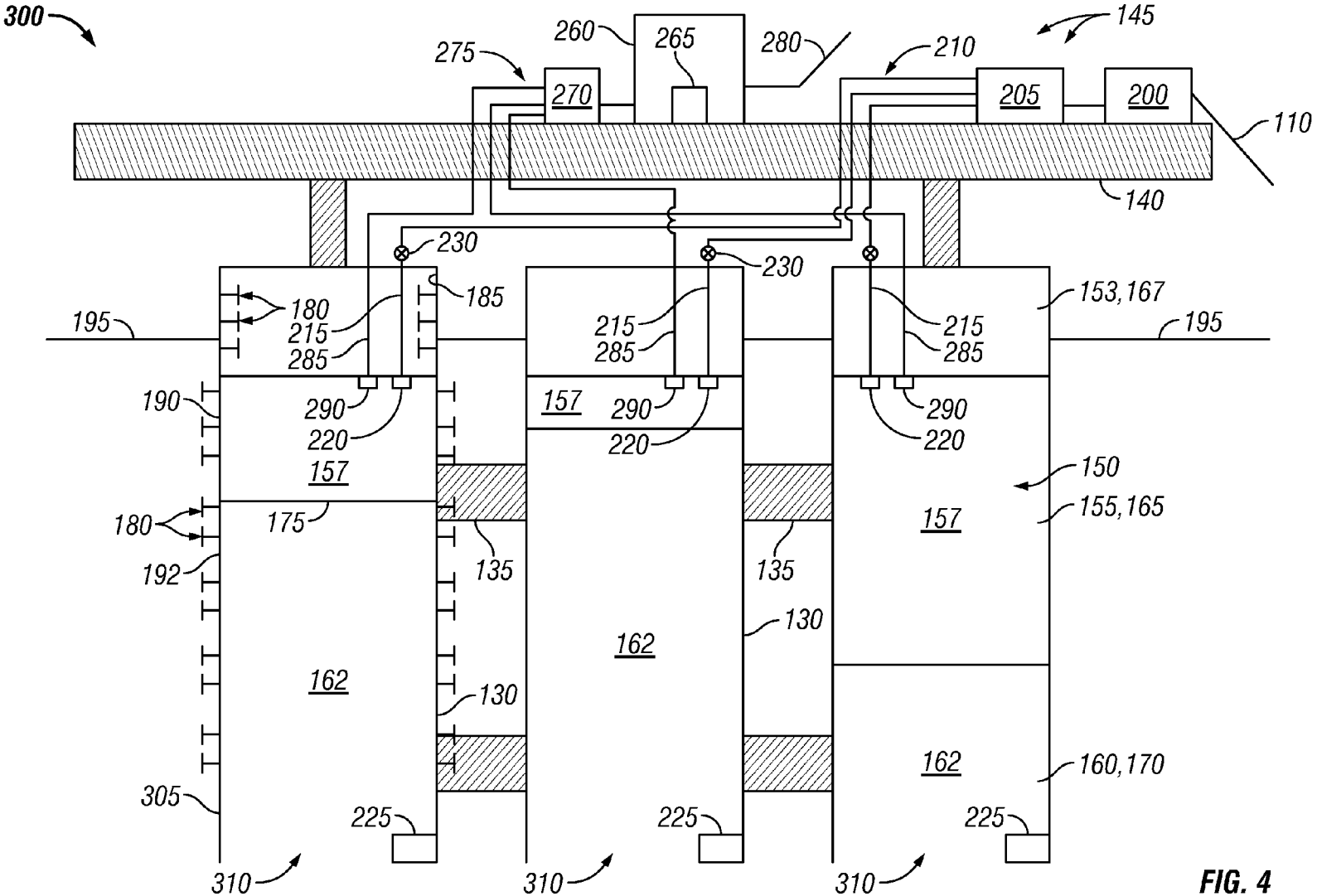
FIG. 4 is a schematic representation of another embodiment of a floating oil storage system in accordance with the principles disclosed herein.

In the above-described embodiment, lower compartment 160 of each cell 130 is enclosed. Seawater 162 that has entered each cell 130 through inlet port 295 may be returned to sea only after conditioning in separator 250. In some circumstances, conditioning of seawater 162 prior to venting the seawater 162 overboard may not be desirable or necessary. FIG. 4 illustrates another embodiment of a cellular storage spar in accordance with the principles disclosed herein, wherein seawater 162 contained within cells 130 is not conditioned, for example, using a separator prior to returning the seawater 162 to sea.

As shown in FIG. 4, each cell 130 of cellular spar 300 is open-ended at its base 305. Seawater freely flows into and out of lower compartment 160 of cell 130 through open-ended base 305. Thus, opening 310 through base 305 is both a seawater inlet and outlet. When oil 157 is delivered into each cell 130, as described above, seawater 162 in lower compartment 160 is forced from cell 130 through opening 310. When oil 157 is depleted from cell 130, also as described above, seawater freely flows into cell 130 through opening 310. Because seawater freely flows into and out of each 130 and is not conditioned prior to reinjection into the surrounding sea, discharge lines 235, manifold 245, and separator 250 are not necessary and hence are not shown in FIG. 4. Aside from these differences, the remaining systems and components of cellular spar 300 are essentially the same both in design and function to those of cellular spar 100 previously described.

Embodiments of a floating oil storage system, or cellular spar, have been described. In either embodiment, oil may be received from an oil-producing offshore structure, such as but not limited to a MCF platform, and stored in one or more storage cells 130 of the cellular spar. Subsequently, the stored oil may be offloaded from the cellular spar to an awaiting tanker. Furthermore, stored oil may be offloaded from one or more storage cells at the same time oil is transferred from the offshore structure and stored in one or more of the remaining storage cells. Hydrostatic pressure of seawater adjacent to and disposed below the stored oil within each storage cell enables offloading of the stored oil without the assistance of a pump.

While preferred embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for storing oil, the method comprising:

transferring oil to a floating storage system having a storage cell with an oil compartment and a seawater compartment disposed below the oil compartment;

delivering the oil into the oil compartment, whereby the oil compartment expands;

contracting the seawater compartment as the oil compartment expands, whereby seawater is discharged from the seawater compartment;

monitoring a distance between a base of the seawater compartment and a floating member; and discontinuing delivery of the oil into the oil compartment when the distance monitored indicates the storage cell is full of oil.

2. The method of claim 1, further comprising separating the oil compartment and the seawater compartment with a floating member displaceable within the storage cell as the oil compartment expands and the seawater compartment contracts.

3. The method of claim 1, wherein the floating member is one of a group consisting of a diaphragm, a bladder, and an inflatable bag.

4. The method of claim 1, wherein the delivering comprises:

pressurizing the oil in a pump;

conveying the pressurized oil into a manifold; and distributing the pressurized oil received by the manifold into a piping system coupled between the manifold and the oil compartment.

5. The method of claim 1, wherein the discontinuing comprises closing a valve coupled to an inlet of the oil compartment.

6. The method of claim 1, further comprising:

delivering oil from the oil storage compartment, whereby the seawater compartment expands; and receiving seawater into the seawater compartment as the seawater compartment expands.

7. The method of claim 6, wherein the delivering oil from the oil compartment comprises:

opening a flowpath from the oil storage compartment; and pushing oil from the oil storage compartment along the flowpath under hydrostatic pressure of seawater in the seawater compartment.

8. The method of claim 6, wherein the transferring oil to the floating oil storage system comprises transferring oil from an oil-producing offshore platform to the floating oil storage system via a subsea transfer line and wherein the delivering of oil from the oil compartment comprises delivering oil from the oil compartment to an oil tanker via a offloading transfer line.

9. The method of claim 1, wherein the storage cell is open-ended, whereby seawater freely flows into and out of the seawater compartment.

10. The method of claim 1, wherein the storage cell comprises an upper compartment disposed above the oil compartment, the upper compartment for buoyancy.

11. The method of claim 1, wherein a first plurality of stiffeners located above sea level are coupled to an inner surface of the storage cell and a second plurality of stiffeners located below sea level are coupled to an outer surface of the storage cell.

12. A floating oil storage system comprising:

a storage cell;

a floating member disposed within the storage cell, whereby the storage cell is divided into a first compartment and a second compartment disposed below the first compartment;

a pump operable to deliver oil under pressure into the first compartment, whereby the first compartment expands and the second compartment contracts expelling seawater from the second compartment; and a suction tank operable to receive oil expelled from the first compartment under hydrostatic pressure of seawater in the second compartment, whereby the first compartment contracts and the second compartment expands receiving seawater;

a pump disposed within the suction tank and operable to deliver oil within the suction tank from the floating oil storage system.

13. The floating oil storage system of claim 12, further comprising:

a separator; and a water discharge line coupled between an outlet in the second compartment and the separator, the water discharge line conveying seawater expelled from the second compartment to the separator.

14. The floating oil storage system of claim 12, wherein the storage cell is open-ended, whereby seawater freely flows into and out of the second compartment.

15. The floating oil storage system of claim 12, wherein the storage cell comprises a third compartment disposed above the first compartment, the third compartment for buoyancy.

16. The floating oil storage system of claim 12, wherein the floating member is displaceable within the storage cell as the first compartment expands and contacts.

17. The floating oil storage system of claim 16, wherein the floating member is one of a group consisting of a diaphragm, a bladder, and an inflatable bag.

18. The floating oil storage system of claim 12, wherein a first plurality of stiffeners located above sea level are coupled to an inner surface of the storage cell and a second plurality of stiffeners located below sea level are coupled to an outer surface of the storage cell.

19. The floating oil storage system of claim 12, wherein the storage cell includes a measurement system configured to measure a distance between a base of the second compartment and the floating member.

20. A cellular spar comprising:

a plurality of storage cells, each storage cell having a first compartment and a second compartment disposed below the first compartment;

a first pump operable to deliver oil under pressure into the first compartment of one or more of the storage cells, whereby the first compartment expands and the second compartment contracts expelling seawater from the second compartment;

a suction tank operable to receive oil expelled from the first compartment of one or more of the storage cells under hydrostatic pressure of seawater in the second compartment, whereby the first compartment contracts and the second compartment expands receiving seawater;

a second pump operable to deliver oil in the suction tank from the cellular spar; and a plurality of stiffeners coupled to one or more of the storage cells, wherein for each of the one or more storage cells, the stiffeners located above sea level are coupled to an inner surface of the storage cell and the stiffeners located below sea level are coupled to an outer surface of the storage cell.

21. The cellular spar of claim 20, wherein the second pump is disposed within the suction tank.

22. The cellular spar of claim 20, further comprising a manifold coupled between the first pump and the first compartments of the storage cells, the manifold operable to deliver pressurized oil from the first pump to one or more of the first compartments.

23. The cellular spar of claim 20, further comprising a manifold coupled between the suction tank and the first compartments of the storage cells, the manifold operable to receive oil expelled from one or more of the first compartments.

24. The cellular spar of claim 20, further comprising:

a manifold;

a water discharge pipe coupled between an outlet in each second compartment and the manifold;

a separator coupled to the manifold; and a vent line coupled to the separator, the vent line for offloading conditioned seawater from the cellular spar.

25. The cellular spar of claim 20, further comprising a floating member disposed between the first compartment and the second compartment of each storage cell, each floating member displaceable within the corresponding storage cell as the first compartment expands and contacts.

26. The cellular spar of claim 25, wherein each storage cell includes a measurement system configured to measure a distance between a base of the second compartment of the storage cell and the floating member of the storage cell.

27. The cellular spar of claim 25, wherein the floating member is one of a group consisting of a diaphragm, a bladder, and an inflatable bag.

28. The cellular spar of claim 20, wherein each storage cell is open-ended, whereby seawater freely flows into and out of the second compartment.

29. The cellular spar of claim 20, wherein each storage cell comprises a third compartment disposed above the first compartment, the third compartment for buoyancy.

* * * * *